United States Patent [19]

Tyler et al.

[11] 4,088,475

[45] May 9, 1978

[54] ADDITION OF REACTIVE ELEMENTS IN POWDER WIRE FORM TO COPPER BASE ALLOYS

[75] Inventors: Derek E. Tyler, Cheshire, Conn.; David W. Dickinson, Hinckley, Ohio; James E. Dore, Ballwin, Mo.; Abid A. Khan, Hamden, Conn.

[73] Assignee: Olin Corporation, New Haven, Conn.

[21] Appl. No.: 738,821

[22] Filed: Nov. 4, 1976

[51] Int. Cl.[2] ..... C22B 15/00; C22C 1/00

[52] U.S. Cl. ..... 75/76; 75/135; 75/153; 75/245; 75/255

[58] Field of Search ..... 75/76, 153, 134, 129, 75/251, 255, 228, 245, 247

[56] References Cited

U.S. PATENT DOCUMENTS

| | | | |
|---|---|---|---|
| 2,888,740 | 6/1959 | Danis | 75/255 |
| 3,634,075 | 1/1972 | Hoff | 75/135 |
| 3,635,701 | 1/1972 | Davies et al. | 75/129 |
| 3,729,309 | 4/1973 | Kawawa | 75/129 |
| 3,768,999 | 10/1973 | Ohkubo et al. | 75/129 |
| 3,915,693 | 10/1975 | Rasmussen | 75/129 |

*Primary Examiner*—Walter R. Satterfield
*Attorney, Agent, or Firm*—Robert A. Dawson; Robert H. Bachman

[57] ABSTRACT

A method for adding reactive elements to molten copper or copper base alloys is disclosed. This method prevents unwanted reactions and oxidation by adding the reactive elements to the molten metal in the form of a powder mixture placed within tubing which is compatible with said molten metal. This filled tubing is sealed and drawn down, if desired, to an appropriate size for rapid melting within said molten metal and consequent rapid dissolution of the reactive elements throughout the molten metal.

7 Claims, No Drawings

ADDITION OF REACTIVE ELEMENTS IN POWDER WIRE FORM TO COPPER BASE ALLOYS

BACKGROUND OF THE INVENTION

Copper base alloys containing reactive elements (Cr, Ti, V, Zr, Mg, B, Be, Sr, Y, Ce, Cb) provide combinations of high strength and high electrical conductivity compared to pure copper or copper containing relatively common alloying elements. A certain problem, however, is presented by the addition of these reactive elements to a copper base. These elements usually possess high melting points which, along with their reactivity, cause problems in the charging of these elements to a molten copper base.

The addition of such reactive elements to copper and copper alloy bases has usually been accomplished by utilizing a copper-reactive element master alloy as the charging system to the molten copper or copper alloy base. This procedure adds to the cost of the final alloy beyond the straight addition of the reactive element since the special processing needed to produce such a master alloy makes such alloys rather expensive and since the amount of reactive element in such a master alloy is usually limited to less than about 10% by weight of the master alloy. This weight restriction generally necessitates the use of relatively large quantities of master alloy to obtain final copper base alloys containing greater than 1% reactive element.

One way of solving this problem would be to utilize pure or nearly pure reactive elements in the charging process of the copper or copper alloy bases. This procedure presents its own problems since the interdiffusion rates of copper and the reactive elements at the molten copper base temperatures are quite slow. An excessively long alloying time is therefore needed to dissolve normal size pieces of these reactive elements (e.g., flakes or pellets).

One way of overcoming this problem has been to provide reactive elements in powder form and directly inject such powder into the molten copper or copper alloy base. While powders provide for shorter interdiffusion rates into the molten base, the large surface area presented by the powders and the inherent reactivity of the elements in powder form present oxidation problems with such a method during charging of the powdered elements to the molten copper or copper alloy base.

One method of overcoming these problems has been to provide such reactive elements in solid clad wire form for charging into a molten copper or copper alloy base. This method is presented in U.S. Pat. No. 3,738,827, which is assigned to the Assignee of the present invention. Such a method alleviates many of the problems discussed above but, in turn, provides the additional step of forming said reactive elements into wire form and then cladding such a wire with a material compatible with the molten base.

It is a principal object of the present invention to provide a method for charging molten copper or copper alloy bases with reactive elements so that the elements readily dissolve with minimal problems from oxidation.

It is a further object of the present invention to provide for charging of reactive elements in powder mixture form to molten copper or copper alloy bases so that the reactive element powders are initially protected by an outer covering which is compatible with the molten bases.

It is an additional object of the present invention to provide for the rapid incorporation of reactive elements into molten copper or copper alloy bases up to the desired weight percentage limits without long melting times or large quantities of master alloys.

Additional objects and advantages will become more apparent from a consideration of the following specification.

SUMMARY OF THE INVENTION

In accordance with the process of the present invention, the foregoing objects and advantages may be readily achieved by obtaining reactive elements in powder form, placing the reactive element powder mixed with copper or copper alloy powder into metal tubing which is compatible with the molten copper or copper alloy bath, sealing the ends of the tubing, drawing down the tubing and finally feeding the drawn tubing or wire into the molten copper or copper alloy base. The total reduction of the powdered element mixture within the tubing is controlled to compact the powders and provide sufficient green strength to the powders to hold them within the tubing during the charging of the tubing into the molten base.

DETAILED DESCRIPTION

The process of the present invention is generally limited to the addition of elements to copper or copper alloy bases. The elements which may be added to such bases include, but are not limited to, elements such as chromium, titanium, vanadium, zirconium, magnesium, boron, beryllium, strontium, yttrium, cerium and columbium (also known as niobium). The factors which these elements should have in common is that they are either quite reactive towards copper or copper alloys or that they have high melting points which generally present problems in combining such elements with molten copper or copper alloy bases.

The process of the present invention attempts to alleviate problems heretofore presented by previously known charging processes by forming compacted filled wires of material compatible with the bases to which the elements are to be added. These wires are formed from tubing which is filled with the reactive elements in powder form and subsequently drawn down to the desired wire size.

In the process of the present invention, tubing is selected which is formed from copper or copper base alloys which are at least compatible with the molten material to which the elements are to be ultimately added. This tubing is filled with powdered reactive elements, either by themselves or in mixtures, combined with copper powder or copper alloy powder, and the ends of the tubing are then sealed off. The tubing is then drawn down to a fine diameter wire to enable the elements and the outer wire to dissolve rapidly in the molten metal to which they are to be added. This drawing process is quite similar to prior art processes utilized for forming wire from solid rod. The total drawing down or reduction is carefully controlled to compact the powder mixture enough to provide sufficient green strength to the powders to hold them within the wire during the subsequent charging operation. This wire, after being drawn down to the desired size, may then be fed into the molten base either as-formed, heated or through a metal-inert gas (MIG) arc, using a conventional wire feed apparatus.

The as-formed filled wire may be fed directly through the melt cover and under the molten metal surface where the protective copper or copper alloy wire sheathing melts and allows the powder to disperse and dissolve throughout the base material. The wire in this form may be fed into the molten base either with or without a shielding inert gas cover.

The filled wire may also be heated during feeding by passing an electrical current through the wire between the feeding apparatus and the molten material. By carefully controlling this current, the operator may bring the wire sheathing to any temperature up to the melting temperature at the point of impingement with the molten material surface. This particular process allows for greater control of the melting rate of the wire, especially at high wire feed rates.

An arc may also be struck between the wire and the molten metal bath. In this particular process, molten droplets of the reactive element and wire are transferred through the metal-inert gas (MIG) arc to the molten bath. An inert gas or a mixture of inert gases may be used as a shielding gas in this operation. In all of these particular charging processes, it is preferred that the molten base be covered with either an amorphous carbon melt cover or a commonly utilized salt flux cover. Such a cover helps to further reduce any unwanted oxidation of the reactive elements before contacting the molten base.

The powdered reactive elements may be utilized in a wide range of sizes. A particularly appropriate size range for the process of the present invention ranges from minus 325 mesh to 0.05 inch for any of the reactive elements contemplated by the present invention. Such a size range is, of course, ultimately determined by the desired speed of dissolution of the elements in the molten metal base. The size range is also determined by the desired amount of total reduction within the tubing used to form the charging wire. It is essential that the reactive elements be mixed with either copper powder or copper alloy powder to form the powder mixture within the tubing utilized in the present invention. The copper or copper alloy powder helps to keep the reactive element powder particles separated long enough to avoid sintering and oxidation of the reactive element powder particles upon contact with the molten metal to which the reactive elements are to be added. The surrounding copper or copper alloy powder particles also help to aid in the rapid dissolution of the reactive element powder particles within the molten metal base. The size range for the copper or copper alloy powder utilized in the present invention will also range from minus 325 mesh to 0.05 inch and will thus be compatible in size to the reactive element particles. As pointed out in the following examples, the ratio of reactive element powder to copper or copper alloy powder must be controlled to prevent sintering of the reactive powder portion of the filled wire.

The present invention will be more readily understood from a consideration of the following illustrative examples.

EXAMPLE I

A 75% Cr-25% Cu powder mixture was placed within a standard 0.25 inch OD (outer diameter) copper tubing which was then drawn down to a 0.0625 inch diameter wire. The wire was then annealed, coiled and fed through a standard "wire feed gun" into a molten 10 lb. bath of phosphorus deoxidized copper, thus forming a Cu-0.2% P–0.25% Cr alloy. The bath temperature was 1150° C before the cold wire addition. No detectable temperature drop in the molten bath was noted either during the wire addition or after the wire addition. The wire feed rate was varied from approximately 60 inch/minute to 200 inch/minute with no apparent dissolution problem. No inert shielding gas was utilized in this process. Metallographic examination of samples taken from the subsequent alloy melt and the resulting ingot formed therefrom indicated that the chromium successfully went into solution within 1 minute after feeding of the wire.

EXAMPLE II 0.0625 inch diameter wire was formed as in Example I utilizing the same powder mixture. This wire was then annealed, coiled and successfully fed through a MIG arc into a 10 lb. bath of molten deoxidized copper to form a Cu-0.2% P-0.3% Cr alloy. Argon was utilized as the shielding gas. The bath temperature was 1150° C before the arc between the bath and the wire was struck. No detectable temperature rise was noted in the molten copper bath and no excessive oxidation was observed either during arc-metal transfer or within metallographic samples taken from the melt or from the resulting ingot. These samples indicated that the chromium additions were successfully dissolved within the molten copper bath within 15 seconds after entry into the bath.

EXAMPLE III

A series of two 0.0625 inch diameter wires were drawn from 0.25 inch OD copper tubing which contained 90% Zr-10% Cu and 75% Zr-25% Cu powder mixtures respectively. No intermittent annealing was necessary during the drawing operation. The wires were fed into 10 lb. baths of phosphorus deoxidized copper held at 1150° C. An alloy was formed within the bath of a nominal composition of 0.2% P, 0.5% Zr, balance Cu. Metallographic examination of samples taken from the melts and resulting ingots indicated that the zirconium successfully dissolved within 1 minute after wire feed start in both baths.

EXAMPLE IV

A 75% Zr-25% Cu powder mixture was placed within a 0.5 inch OD copper tubing which was then sealed and drawn down to a 0.375 inch diameter wire. This wire was fed into a standard wire feeder into the transfer trough during direct chill casting of copper base alloy CDA 638 (95% Cu, 2.8% Al, 1.8% Si, 0.4% Co) to yield a zirconium level in the alloy of 0.2%. Metallographic examination of the direct chill cast ingot at various locations along its length indicated a successful dissolution of the zirconium throughout the entire alloy.

EXAMPLE V

Powder mixtures of 90% Ti-10% Cu and 75% Ti-25% Cu were placed within two 0.25 inch OD copper tubes which were then sealed and fed into 10 lb. baths of a copper base alloy held at 1175° C to form a Cu-1.5% Sb-0.5% Ti alloy. Metallographic examination of samples taken from the melt and resulting ingots indicated that the titanium successfully dissolved within the melt within 1 minute after feeding in of the wire.

It should be noted that throughout the examples the percentages were in terms of weight percent.

These examples indicate that powder mixtures containing high percentages of normally reactive elements may be successfully and quickly dissolved within copper or copper alloy molten baths without premature and undesirable reaction or oxidation. This process also provides for uniform distribution of the reactive elements throughout the resulting alloys.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of euqivalency are intended to be embraced therein.

What is claimed is:

1. A method for adding reactive elements to a molten metal mass consisting essentially of the following steps:

(a) providing a reactive element powder or a mixture of reactive elements in powder form wherein said reactive element is selected from the group consisting of chromium, titanium, vanadium, zirconium, magnesium, boron, beryllium, strontium, yttrium, cerium, niobium and mixtures thereof, said reactive element or mixture being mixed with copper powder or copper base alloy powder;

(b) providing a molten mass of metal selected from the group consisting of copper and copper base alloys which are compatible with both said reactive elements and said copper powder or copper base alloy powder;

(c) placing the powder mixture into tubing formed from metal compatible with said molten mass of metal and said powder mixture and sealing the ends of said tubing; and (d) adding the tubing filled with said powder mixture to said molten metal mass to enable dissolution and uniform distribution of said reactive elements and copper or copper base alloy throughout the entire molten metal mass.

2. A method according to claim 1 wherein said powder filled tubing is fed through a melt cover selected from the group consisting of amorphous carbon and salt which is placed on the surface of said molten metal mass.

3. A method according to claim 1 wherein said powder filled tubing is fed into said molten metal mass under a shield of an inert gas or mixture of inert gases.

4. A method according to claim 1 wherein the size of said reactive element powder and said copper powder or said copper base alloy powder ranges from minus 325 mesh to 0.05 inch.

5. A method according to claim 1 wherein said tubing is drawn down into wire form while simultaneously compacting said powder mixture present therein to form a powder filled wire after sealing the ends of said tubing but before adding said tubing to said molten metal mass.

6. A method according to claim 5 wherein said powder filled wire is heated after drawing and then fed into said molten metal mass.

7. A method according to claim 5 wherein said powder filled wire is led through a metal-inert gas arc and placed into said molten metal mass directly from said arc.

* * * * *